United States Patent [19]

Shieh

[11] Patent Number: 4,901,608

[45] Date of Patent: Feb. 20, 1990

[54] ADJUSTABLE ANGLE RATCHET WRENCH

[76] Inventor: James Shieh, No. 368-1, Lane 114, Yuan Hwan East Road, Feng Yuan City, Taichung Hsien, Taiwan

[21] Appl. No.: 315,565

[22] Filed: Feb. 27, 1989

[51] Int. Cl.[4] ..... B25G 1/00

[52] U.S. Cl. ..... 81/177.8

[58] Field of Search ..... 81/177.8, 177.9

[56] References Cited

U.S. PATENT DOCUMENTS

| | | | |
|---|---|---|---|
| 763,745 | 6/1904 | Gheen | 87/177.8 X |
| 2,518,139 | 8/1950 | Hallowell et al. | 87/177.9 X |
| 2,921,773 | 1/1960 | Hoelzer | 81/177.8 X |
| 4,794,829 | 1/1989 | Mesenhoeller | 81/177.8 |

FOREIGN PATENT DOCUMENTS

| | | | |
|---|---|---|---|
| 3023882 | 7/1982 | Fed. Rep. of Germany | 81/177.8 |

*Primary Examiner*—James G. Smith

*Attorney, Agent, or Firm*—Bacon & Thomas

[57] ABSTRACT

The invention relates to an adjustable angle ratchet wrench. A ratchet wrench head is provided with a toothed protrusion. The handle has a forked end to receive the protrusion and the head and handle are hinged about a bolt therethrough. Between the tines of the fork is also disposed a gear having two different size diameters. This gear is provided on the shaft of a button which is spring loaded. In the normal position the large gear engages with the teeth of the protrusion on the head and the smaller gear engages with an inwardly toothed section of one tine of the fork such that the wrench head and handle are held rigid. When the button is depressed, the smaller gear disengages from the handle and the wrench head and handle are free to rotate through an angle of approximately 180 degrees with respect to each other. When the button is released, the spring loaded returns the gear to the normal position and the handle is fixed again.

2 Claims, 4 Drawing Sheets

ADJUSTABLE ANGLE RATCHET WRENCH

BACKGROUND OF THE INVENTION

The present invention relates to a ratchet wrench and in particular to an adjustable angle ratchet wrench.

Heretofore, fixed handle ratchet wrenches were developed to facilitate the easy rotation or ratcheting of nuts and bolts. Further to this, straight extensions of different lengths were developed to accommodate hard to reach places. However, at times even this improvement was inadequate for some uses. A ratchet wrench with an adjustable angle handle was then developed. A representation of such is shown in FIG. 5 (U.S. Pat. No. 4,711,145) wherein a toothed portion 72 of the ratchet head 7 engages with a spring-loaded ball 82 and is rotatable about the central axis of the toothed portion. This design could afford different angles to the handle but under load conditions this design has the tendency to easily change angle if the torque is not carefully applied parallel to the plane of the ratchet head. This, usually sudden, change in angle quite often results in injury to the user in the form of cuts, bruises, scrapes etc., and also damage to the nut or bolt that the torque is being applied to.

SUMMARY OF THE INVENTION

It is therefore a primary object of the present invention to mitigate and/or obviate the afore-mentioned drawbacks by providing an adjustable angle ratchet wrench that is easy and convenient to use.

Another object of the present invention is to provide an adjustable angle ratchet wrench that is adjustable through an angle of approximately 180 degrees.

Another object of the present invention is to provide an adjustable angle ratchet wrench that is rigidly fixable at any angle from plus 90 to minus 90 degrees with respect to the plane of the ratchet head.

To obviate the aforementioned drawbacks and improve functionality, the present invention provides a handle hinged about a first toothed gear by a second toothed gear. The second toothed gear is spring-loaded such that, in the normal position, it is engaged with teeth of the wrench head and teeth located within the handle to fix the handle in a rigid position. To disengage, a button is depressed, a spring is compressed and the set of teeth of the second gear engaging the teeth of the handle disengage to allow rotation of the handle. The present invention offers the rigidity of a fixed handle ratchet wrench while also providing the convenience of an adjustable angle handle.

Other objects and advantages of the present invention will become apparent to those skilled in the art upon reading the detailed description provided hereinbelow, with appropriate reference to the accompanying drawings.

DETAILED DESCRIPTION OF THE PREFERRED EMBODIMENT

Figure 1:
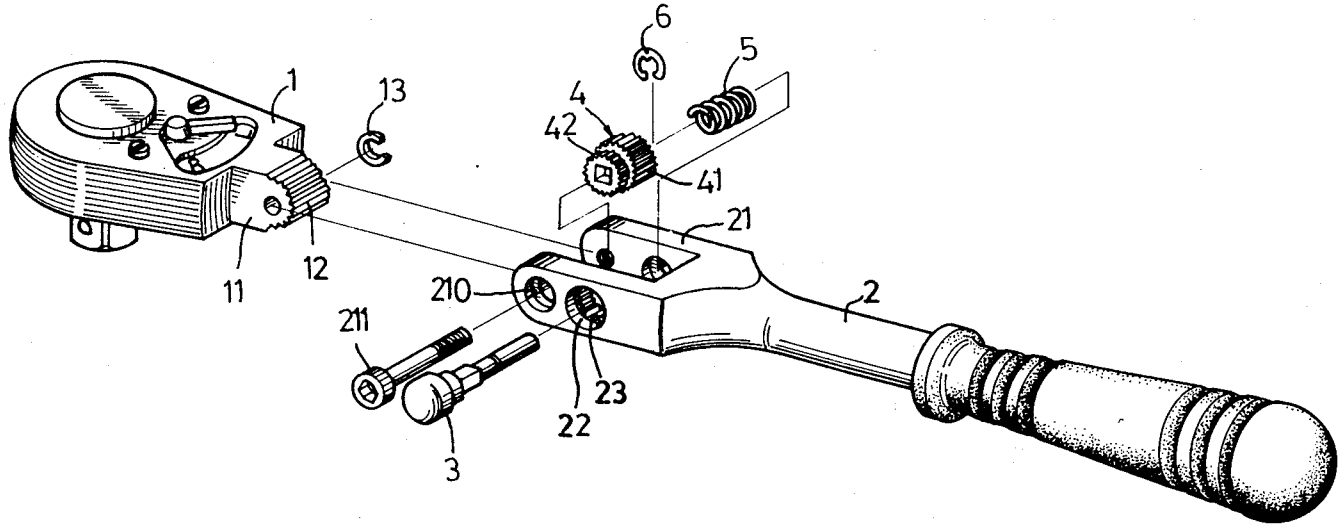
FIG. 1 is an exploded view of an adjustable angle ratchet wrench in accordance with the present invention.

Referring to the perspective view of FIG. 1, wherein a ratchet wrench head 1 is shown, on a side of the ratchet wrench head 1 perpendicular to the drive shaft a rectangular protrusion 11 is extended. The distal end of the protrusion 11 is shaped in a semi-cylindrical fashion and is toothed to form a segment teeth 12. The width of the protrusion 11 and segment teeth 12 is such that they fit within a Y-shaped opening formed by the tines 21 of the fork in the handle 2. The tines 21 are rectangular in shape and at the distal end of each are semi-cylindrical in shape about an axis between the tines 21. The tines 21 are bored with a cylindrical bore 210. The bore 21 consists of a threaded section within one tine of the fork and a stepped cylindrical opening in the other. The outer diameter of the stepped cylindrical opening is larger to accommodate the head of a bolt 211, and the small diameter corresponds to the diameter of the bolt 211 and the threaded section engaging with the threaded section of the bolt 211. The segment teeth 12 of the ratchet wrench head 1 is bored with a centrally cylindrical opening corresponding to the size of the bolt 211. The protrusion 11 and the first gear 12 of the ratchet wrench head 1 engage with the tines 21 of the fork in the handle 2 by means of the bolt 211 passing through the bore 210. A C-shaped ring 13 is provided over the bolt 211 adjacent to the inside surface of the threaded tine 21 to prevent over tightening and allow for free rotation about the bolt 211.

Along another axis between the tines 21 of the fork in the handle running parallel to the previously mentioned axis, there is a cylindrical opening 22. Within one tine 21 the opening 22 consists of a circular shape corresponding to the diameter of a head portion of a button 3 and an inner toothed section 23. On the other tine 21, a first section is circular and of a diameter to accommodate the spring 5 while the remainder is also circular and corresponding in size to a shaft portion of the button 3. The button 3 consists of the head portion followed by a and a rectangular section and then the shaft portion. The rectangular section of the button 3 engages with a rectangular opening of a teeth gear 4, while the subsequent portion of the shaft of the button 3 passes through a cylindrical opening and protrudes from the opposite side of the gear teeth 4. The gear teeth 4 consists of a set of first teeth 41 and a set of second teeth 42, the latter being smaller and of an appropriate size to engage with the inner toothed section 23 of the handle 2, while the former being of a larger diameter and toothed to engage the segment teeth 12 of the the ratchet wrench head 1. The button 3 is inserted to the opening 22 passing through the gear teeth 4. The spring 5 is placed over the shaft portion of the button 3 and seats in the larger cylindrical opening 22 on the opposite tine 21 from the button head. The button 3 is then secured in place by an E-ring washer 6 in an annular groove 31 of the shaft just at the edge of the first teeth 41 of the gear teeth 4.

Figure 2:
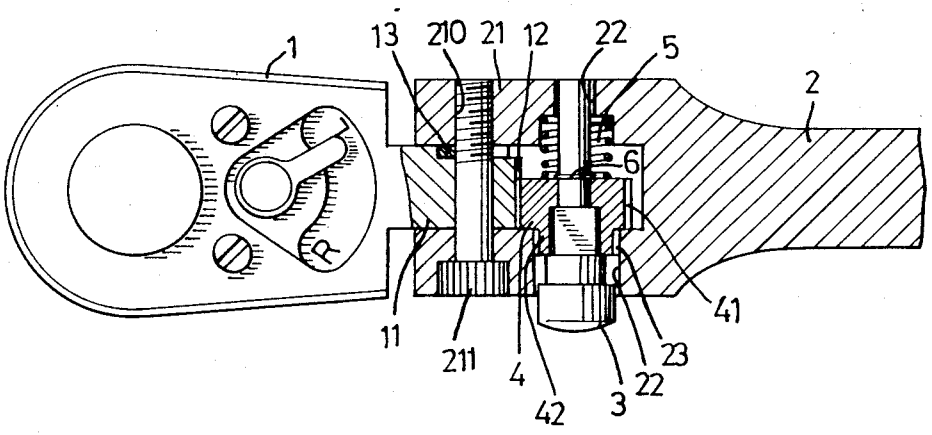
FIG. 2 is a cross-sectional top view of the wrench of FIG. 1 in which all gears are in the normal or engaged mode.
Figure 3:
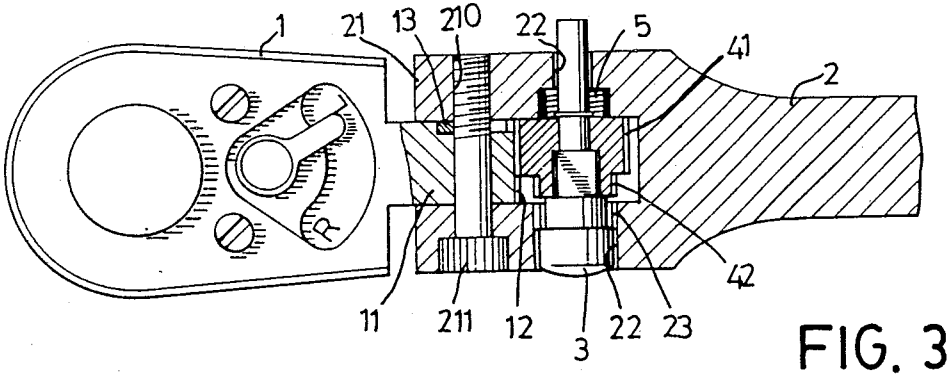
FIG. 3 is a cross-sectional top view of FIG. 1 in which the button is depressed and the gear is released from engagement with the handle.

FIG. 2 shows the adjustable angle ratchet wrench handle 2 in the normal engaged mode while FIG. 3 shows the adjustable angle ratchet wrench handle 2 in the disengaged, moveable mode. As can be seen from FIG. 2, the handle 2 is hinged to the ratchet wrench head 1 by means of the bolt 211. The segment teeth 12 of the ratchet wrench head 1 are directly engaged with the first teeth 41 of the gear teeth 4. From the tension of the spring 5, the gear teeth 4 is forced such that the second teeth 42 of the gear teeth 4 engages with the tooth section 23 of the opening 22 and the side of the first teeth 41 bears against an inner wall of the tine 21. In this position, the gear teeth 4 is rigidly fixed with respect to the handle 2, and as such, the ratchet wrench head 1 is also rigidly fixed due to the engagement of the first teeth 41 and the teeth of the segment teeth 12.

Figure 4:
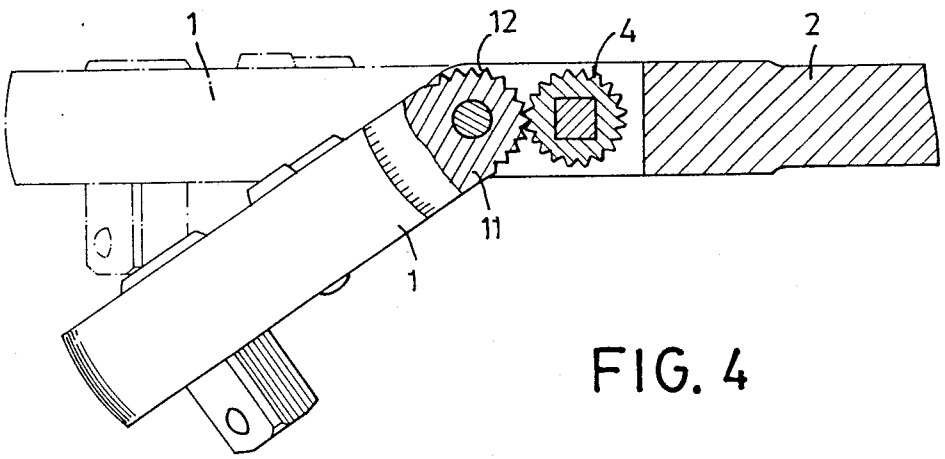
FIG. 4 is a cross-sectional side view of the wrench of FIG. 1 illustrating the rotation of the handle with respect to the ratchet wrench head.
Figure 5:
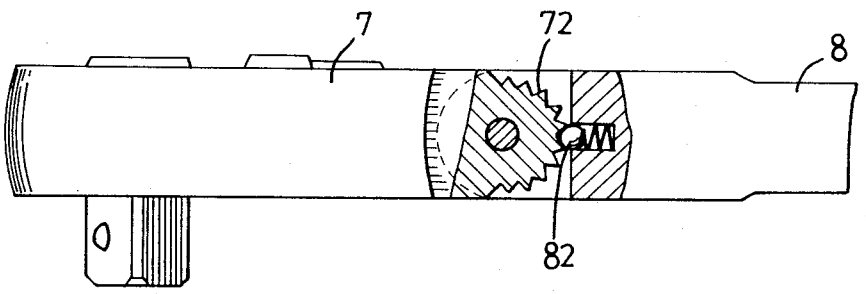
PRIOR ART FIG. 5
FIG. 5 is a cross-sectional side view of an embodiment of the prior art.

In FIG. 3, the button 3 is depressed and the spring 5 is compressed. When the button 3 is depressed, the second teeth 42 of the gear teeth 4 disengage with the tooth section 23 of the opening 22. The first teeth 41 of the gear teeth 4 still remain in contact with the segment teeth 12 of the ratchet wrench head 1. While in this mode the teeth of the two gears mesh together and the handle 2 is able to rotate about the bolt 211 to change the angle of the handle 2 with respect to the plane of the ratchet wrench head 1. The cross-sectional view of FIG. 4 more clearly illustrates the relationship and relative motion of the ratchet wrench head 1 to the handle 2. It should also be noted that the handle can be rotated through an arc of approximately 180 degrees.

While the present invention has been explained in relation to its preferred embodiment, it is to be understood that various modifications thereof will be apparent to those skilled in the art upon reading this specification. The invention disclosed herein is therefore intended to cover all such modifications as fall within the scope of the appended claims.

I claim:

1. An adjustable angle ratchet wrench comprising:

(a) a wrench head including a rectangular protrusion extending outwardly from a side thereof disposed perpendicular to a drive shaft, the protrusion being provided with a semi-cylindrical first gear at one end thereof and a central cylindrical passageway;

(b) a handle including a fork defined by a pair of tines forming a Y-shaped opening sized for receiving the protrusion therein, each tine being substantially rectangular in shape and terminating in an end having a semi-cylindrical shape;

(c) a first cylindrical bore extending through the tines and including a threaded section in one tine and a stepped section in the other tine, and a bolt extending through the cylindrical bore and the central cylindrical passageway of the protrusion, the bolt being disposed in threaded engagement with the threaded section;

(d) a second cylindrical bore extending through the tines and including an outer section and toothed section in one tine, and a larger diameter inner cylindrical opening and a smaller diameter outer cylindrical opening in the other tine;

(e) a second gear provided with teeth on its outer surface and including a set of larger first teeth engageable with the first gear and a set of smaller second teeth engageable with the toothed section, the second gear further including a central rectangular bore and a cylindrical passage;

(f) a button including a cylindrical head portion, a reduced diameter cylindrical section, a rectangular section and a cylindrical shaft, the rectangular section being disposed within the central rectangular bore of the second gear and the cylindrical shaft being received through the cylindrical passage of the second gear, and a spring surrounding the cylindrical shaft and seated within the inner cylindrical opening of the tine, and means for securing the button to the tines;

(g) the wrench head being hinged to the handle for pivotal movement about the bolt during engagement of the first gear and the first teeth of the second gear, the second teeth of the second gear being urged by the spring into engagement with the toothed section of the tine so that the second gear may be disposed in rigid engagement with the handle and secure the wrench head in a rigid fixed position with respect to the handle; and (h) whereby when the button is depressed against the spring, the smaller second teeth of the second gear is released from engagement with the toothed section of the tine, thereby permitting the wrench head to freely pivot with respect to the handle through an angle of approximately 180° C. about the bolt.

2. The wrench of claim 1 wherein the means for securing the button to the tines includes an annular groove formed in the cylindrical shaft adjacent the second gear, and a ring washer disposed in the annular groove.

* * * * *